US007845150B2

(12) United States Patent
Gibbons

(10) Patent No.: US 7,845,150 B2
(45) Date of Patent: Dec. 7, 2010

(54) HORSE HALTER WITH CHIN STRAP

(75) Inventor: Clay Gibbons, Worland, WY (US)

(73) Assignee: CowboyLogic, LLC, Worland, WY (US)

( * ) Notice: Subject to any disclaimer, the term of this patent is extended or adjusted under 35 U.S.C. 154(b) by 358 days.

(21) Appl. No.: 12/165,621

(22) Filed: Jun. 30, 2008

(65) Prior Publication Data

US 2009/0320418 A1 Dec. 31, 2009

(51) Int. Cl.
*B68B 1/02* (2006.01)

(52) U.S. Cl. ..... 54/24

(58) Field of Classification Search ..... 54/6.1, 54/6.2, 24

See application file for complete search history.

(56) References Cited

U.S. PATENT DOCUMENTS

| | | | |
|---|---|---|---|
| 11,586 | A | 8/1854 | Merriam et al. |
| 28,121 | A | 5/1860 | Whitehead |
| 35,932 | A | 7/1862 | Griswold |
| 43,781 | A | 8/1864 | Le Baron |
| 51,582 | A | 12/1865 | Gibbs |
| 62,662 | A | 3/1867 | McKibben |
| 73,711 | A | 1/1868 | Garrison et al. |
| 81,552 | A | 8/1868 | Steinbruecke |
| 87,246 | A | 2/1869 | Cross |
| 100,031 | A | 2/1870 | Harris |
| 109,937 | A | 12/1870 | Porter |
| 113,468 | A | 4/1871 | Thornton |
| 118,877 | A | 9/1871 | Osborn et al. |
| 121,704 | A | 12/1871 | Carpenter |
| 123,653 | A | 2/1872 | Wesson |
| 130,604 | A | 8/1872 | Thornton et al. |
| 146,646 | A | 1/1874 | Brooks |
| 147,885 | A | 2/1874 | Wiswell |
| 149,610 | A | 4/1874 | Schmit |
| 153,911 | A | 8/1874 | Reed |
| 156,127 | A | 10/1874 | Brada |
| 166,683 | A | 8/1875 | Chase |
| 168,841 | A | 10/1875 | McKibben |
| 175,769 | A | 4/1876 | Shinnick |
| 179,898 | A | 7/1876 | Cronin |
| 181,627 | A | 8/1876 | Bowdow |
| 183,918 | A | 10/1876 | Frazier |
| 185,985 | A | 1/1877 | Straus |
| 188,421 | A | 3/1877 | Schmolze |
| 195,777 | A | 10/1877 | Stone |
| 200,720 | A | 2/1878 | Henkell |
| 203,324 | A | 5/1878 | Cox |
| 204,084 | A | 5/1878 | Halter |
| 206,586 | A | 7/1878 | Leland |
| 207,467 | A | 8/1878 | Whitman |
| 220,498 | A | 10/1879 | Scott |
| 227,026 | A | 4/1880 | Madden |
| 237,031 | A | 1/1881 | Mauk et al. |
| 246,922 | A | 9/1881 | Trott |
| 247,912 | A | 10/1881 | Hess |
| 251,074 | A | 12/1881 | Stowell |
| 251,506 | A | 12/1881 | Barnard |

(Continued)

*Primary Examiner*—Rob Swiatek
(74) *Attorney, Agent, or Firm*—Antoinette M. Tease

(57) ABSTRACT

A horse halter comprising a nose band, chin strap, hitching strap, jaw strap, throat strap, two cheek straps, and poll strap, wherein a lead rope is attached to the hitching strap, and wherein when the lead rope is pulled downward, the nose band and chin strap exert a clamping action on the horse's nose and mouth.

9 Claims, 8 Drawing Sheets

U.S. PATENT DOCUMENTS

| | | | |
|---|---|---|---|
| 255,395 | A | 3/1882 | Rorebeck |
| 258,325 | A | 5/1882 | Smith |
| 258,543 | A | 5/1882 | Barnard |
| 259,200 | A | 6/1882 | Ostberg |
| 364,178 | A | 9/1882 | Marker |
| 265,252 | A | 10/1882 | Farr |
| 266,831 | A | 10/1882 | Johnston |
| 266,248 | A | 11/1882 | Latta |
| 277,354 | A | 5/1883 | Sears |
| 277,380 | A | 5/1883 | Thornton |
| 280,237 | A | 6/1883 | Porter |
| 281,952 | A | 7/1883 | Armstrong |
| 283,539 | A | 8/1883 | Upton |
| 284,540 | A | 9/1883 | Cooper |
| 286,602 | A | 10/1883 | Garfield |
| 288,595 | A | 11/1883 | Rorebeck |
| 290,826 | A | 12/1883 | White et al. |
| 291,365 | A | 1/1884 | Lighthouse |
| 293,999 | A | 2/1884 | Barnard |
| 295,273 | A | 3/1884 | Nesbit |
| 295,812 | A | 3/1884 | Rorebeck |
| 297,963 | A | 5/1884 | Barnard |
| 302,222 | A | 7/1884 | Melling |
| 304,411 | A | 9/1884 | Corbett |
| 309,611 | A | 12/1884 | Du Bois |
| 318,409 | A | 5/1885 | Andes |
| 321,957 | A | 7/1885 | Enoch |
| 324,237 | A | 8/1885 | Diming |
| 331,670 | A | 12/1885 | Wood |
| 332,271 | A | 12/1885 | Michaelis |
| 335,726 | A | 2/1886 | Turnbull |
| 339,996 | A | 4/1886 | Michaelis |
| 340,324 | A | 4/1886 | Keller |
| 341,200 | A | 5/1886 | Wood |
| 352,371 | A | 11/1886 | Smith |
| 357,643 | A | 2/1887 | Thummel et al. |
| 360,035 | A | 3/1887 | Michaelis |
| 362,494 | A | 5/1887 | Covert |
| 363,033 | A | 5/1887 | Wheeler |
| 363,311 | A | 5/1887 | Arnold |
| 366,972 | A | 7/1887 | Michaelis |
| 367,831 | A | 8/1887 | Moss |
| 367,943 | A | 8/1887 | Wittemore |
| 370,163 | A | 9/1887 | Schaefer |
| 370,346 | A | 9/1887 | Lynch et al. |
| 371,137 | A | 10/1887 | Grant |
| 371,754 | A | 10/1887 | Gethmann et al. |
| 379,056 | A | 3/1888 | Dowlin |
| 379,369 | A | 3/1888 | Covert |
| 381,123 | A | 4/1888 | Frost |
| 381,693 | A | 4/1888 | Gross |
| 382,692 | A | 5/1888 | Covert |
| 383,836 | A | 5/1888 | Stuart |
| 384,407 | A | 6/1888 | Walton |
| 401,017 | A | 4/1889 | Dunn |
| 401,922 | A | 4/1889 | Barnard |
| 409,867 | A | 8/1889 | Philpott |
| 416,227 | A | 12/1889 | Lally |
| 417,638 | A | 12/1889 | Harmon |
| 417,864 | A | 12/1889 | Gleiser |
| 417,870 | A | 12/1889 | Krater |
| 422,626 | A | 3/1890 | Pruyne |
| 423,974 | A | 3/1890 | Wheeler |
| 428,898 | A | 5/1890 | Duncan |
| 431,828 | A | 7/1890 | Walbridge |
| 432,414 | A | 7/1890 | Knight |
| 434,182 | A | 8/1890 | Gethmann et al. |
| 441,732 | A | 12/1890 | Wilson et al. |
| 444,993 | A | 1/1891 | Shippy |
| 460,840 | A | 10/1891 | Beam |
| 462,743 | A | 11/1891 | Sisson |
| 464,283 | A | 12/1891 | Hush |
| 465,777 | A | 12/1891 | Edwards et al. |
| 477,644 | A | 6/1892 | Chambers, Jr. |
| 483,594 | A | 10/1892 | Averill |
| 485,278 | A | 11/1892 | Hutton |
| 487,145 | A | 11/1892 | Gibbons |
| 496,705 | A | 5/1893 | Staples |
| 501,619 | A | 7/1893 | Hobart et al. |
| 506,475 | A | 10/1893 | Covert |
| 512,290 | A | 1/1894 | Green et al. |
| 514,523 | A | 2/1894 | Wagner |
| 520,381 | A | 5/1894 | Sheriff |
| 521,457 | A | 6/1894 | Burnett |
| 522,408 | A | 7/1894 | Doble |
| 526,593 | A | 9/1894 | Waters |
| 528,760 | A | 11/1894 | Casey |
| 551,375 | A | 12/1895 | Green et al. |
| 564,139 | A | 7/1896 | Barhydt |
| 592,292 | A | 10/1897 | Johnson |
| 643,123 | A | 2/1900 | Green et al. |
| 659,110 | A | 10/1900 | Smith |
| 660,494 | A | 10/1900 | Evans |
| 675,014 | A | 5/1901 | Raeuchle |
| 675,910 | A | 6/1901 | Thomas |
| 694,531 | A | 3/1902 | Cooley |
| 698,560 | A | 4/1902 | Rugg |
| 699,947 | A | 5/1902 | Ellis |
| 723,999 | A | 3/1903 | Fosgate |
| 734,903 | A | 7/1903 | Lewis |
| 736,275 | A | 8/1903 | Little |
| 741,873 | A | 10/1903 | Barcus |
| 770,663 | A | 9/1904 | Severns |
| 778,511 | A | 12/1904 | Spohn |
| 793,460 | A | 6/1905 | Morrison |
| 796,025 | A | 8/1905 | Wilhelm |
| 813,062 | A | 2/1906 | McGehee |
| 815,164 | A | 3/1906 | Hayner |
| 817,135 | A | 4/1906 | Smouse |
| 839,980 | A | 1/1907 | Bramer |
| 843,689 | A | 2/1907 | McClintock |
| 856,415 | A | 6/1907 | McClintock |
| 871,925 | A | 11/1907 | Gates |
| 887,862 | A | 5/1908 | Spangenberg |
| 891,253 | A | 6/1908 | Hegland |
| 896,164 | A | 8/1908 | Schreiter |
| 897,329 | A | 9/1908 | Weber |
| 897,565 | A | 9/1908 | Walker |
| 904,321 | A | 11/1908 | Farrer |
| 911,232 | A | 2/1909 | Grifen |
| 915,243 | A | 3/1909 | Stewart |
| 917,059 | A | 4/1909 | Hansen |
| 923,369 | A | 6/1909 | McClintock |
| 925,371 | A | 6/1909 | McClintock |
| 925,372 | A | 6/1909 | McClintock |
| 964,947 | A | 7/1910 | Varney |
| 985,642 | A | 2/1911 | Tallman |
| 1,070,786 | A | 8/1913 | Dyer |
| 1,088,877 | A | 3/1914 | Curtis |
| 1,093,486 | A | 4/1914 | Scott |
| 1,115,788 | A | 11/1914 | Dance et al. |
| 1,122,587 | A | 12/1914 | Grady |
| 1,124,054 | A | 1/1915 | Meyer |
| 1,130,711 | A | 3/1915 | Curtis |
| 1,136,693 | A | 4/1915 | Mertz |
| 1,138,115 | A | 5/1915 | Johnson |
| 1,184,643 | A | 5/1916 | Hartman |
| 1,216,966 | A | 2/1917 | Drew |
| 1,227,440 | A | 5/1917 | Hoffman |
| 1,232,308 | A | 7/1917 | Higgins |
| 1,250,246 | A | 12/1917 | Trenham |
| 1,254,412 | A | 1/1918 | Kub |
| 1,278,021 | A | 9/1918 | Robinson |
| 1,288,806 | A | 12/1918 | Bellman |

| | | | |
|---|---|---|---|
| 1,325,061 | A | 12/1919 | Veal |
| 1,351,620 | A | 8/1920 | Canter |
| 1,352,557 | A | 9/1920 | Stansbie |
| 1,374,087 | A | 4/1921 | McClintock |
| 1,525,676 | A | 2/1925 | Warnes |
| 1,532,853 | A | 4/1925 | Lawson |
| 1,536,507 | A | 5/1925 | Lawson |
| 1,556,362 | A | 10/1925 | Slbert |
| 1,570,225 | A | 1/1926 | Beckwith |
| 1,580,553 | A | 4/1926 | Brenny |
| 1,633,268 | A | 6/1927 | Nelson et al. |
| 1,734,891 | A | 11/1929 | Beckwith |
| 1,743,889 | A | 1/1930 | Hannam |
| 1,746,403 | A | 2/1930 | Mulcahy |
| 1,747,012 | A | 2/1930 | Johnson |
| 1,751,226 | A | 3/1930 | Beckwith |
| 1,793,488 | A | 2/1931 | Johnson |
| 1,796,698 | A | 3/1931 | Winslow |
| 1,804,655 | A | 5/1931 | Swanjord |
| 1,939,107 | A | 12/1933 | Crandall |
| 2,114,178 | A | 4/1938 | Crandall |
| 2,304,338 | A | 12/1942 | Crandall |
| 2,525,684 | A | 10/1950 | Kinskie |
| 2,526,140 | A | 10/1950 | Keyston |
| 2,622,381 | A | 12/1952 | Mundell |
| 2,804,741 | A | 9/1957 | Cheesebro |
| 2,932,930 | A | 4/1960 | Ray |
| 3,098,336 | A | 7/1963 | Bearss |
| 3,263,399 | A | 8/1966 | Faragher |
| 3,273,311 | A | 9/1966 | Henry |
| 3,312,039 | A | 4/1967 | Reed |
| 3,407,568 | A | 10/1968 | Henry |
| 3,418,787 | A | 12/1968 | Smith |
| 3,564,669 | A | 2/1971 | Henry |
| 3,579,963 | A | 5/1971 | Henry |
| 3,605,384 | A | 9/1971 | Pacini |
| 3,731,456 | A | 5/1973 | Hill |
| 3,949,538 | A | 4/1976 | Woodruff |
| 4,094,131 | A | 6/1978 | McElvey |
| 4,106,266 | A | 8/1978 | Hibbert |
| 4,135,348 | A | 1/1979 | Matthews |
| 4,173,109 | A | 11/1979 | Hibbert |
| 4,180,963 | A | 1/1980 | Anderson |
| 4,324,089 | A | 4/1982 | Hart et al. |
| 4,337,610 | A | 7/1982 | Taylor |
| 4,369,615 | A | 1/1983 | Bloodworth |
| 4,376,366 | A | 3/1983 | Miller |
| 4,459,795 | A | 7/1984 | Le Tixerant |
| 4,472,925 | A | 9/1984 | Woodruff |
| 4,480,427 | A | 11/1984 | Conrad |
| 4,495,752 | A | 1/1985 | Simpson |
| 4,495,753 | A | 1/1985 | Simpson |
| 4,502,265 | A | 3/1985 | Horrigan |
| 4,524,569 | A | 6/1985 | Hanna |
| 4,565,055 | A | 1/1986 | Simpson |
| 4,589,248 | A | 5/1986 | Ruddock |
| 4,774,801 | A | 10/1988 | Johansen et al. |
| 4,852,336 | A | 8/1989 | Gammill |
| 5,079,904 | A | 1/1992 | Berube |
| 5,086,611 | A | 2/1992 | Purdy |
| 5,615,539 | A | 4/1997 | Graham |
| 5,660,031 | A | 8/1997 | Clark |
| 6,062,005 | A | 5/2000 | Roberts |
| 6,199,352 | B1 | 3/2001 | Beaston |
| 6,199,353 | B1 | 3/2001 | Chladek et al. |
| 6,691,497 | B1 | 2/2004 | Rodgers |
| 6,775,964 | B2 | 8/2004 | Rodgers |
| 6,817,165 | B1 | 11/2004 | Bateman |
| 7,124,562 | B2 | 10/2006 | Blocker |
| 7,246,477 | B2 | 7/2007 | Hurwitz |
| 7,263,816 | B2 | 9/2007 | Hurwitz |
| 7,340,874 | B2 | 3/2008 | Bechtold |
| 2003/0101698 | A1 | 6/2003 | Oyster et al. |
| 2004/0065061 | A1 | 4/2004 | Rodgers |
| 2004/0168413 | A1 | 9/2004 | Rodgers |
| 2005/0034435 | A1 | 2/2005 | Kemp et al. |
| 2005/0217220 | A1 | 10/2005 | Blocker |
| 2006/0026933 | A1 | 2/2006 | Hurwitz |
| 2006/0026934 | A1 | 2/2006 | Hurwitz |
| 2006/0156698 | A1 | 7/2006 | Barnes |
| 2006/0185331 | A1 | 8/2006 | Pretty |
| 2006/0288670 | A1 | 12/2006 | Blocker |
| 2007/0051324 | A1 | 3/2007 | Grayson |
| 2007/0089380 | A1 | 4/2007 | Rechtold |
| 2008/0034716 | A1 | 2/2008 | Foster |

HORSE HALTER WITH CHIN STRAP

BACKGROUND OF THE INVENTION

1. Field of the Invention

The present invention relates generally to the field of animal halters, and more specifically, to a horse halter with a nose band, chin strap and sliding jaw strap that together create a clamping pressure on the forward portion of the horse's nose and jaw, as well as on the horse's poll, when the lead rope is pulled.

2. Description of the Related Art

Existing horse halters generally come in two forms—a rope halter and a strap halter. The strap halter is constructed of strap and hardware and sewn together to form the halter shown in FIG. 1. The rope halter is constructed of rope and hand-tied to form the halter shown in FIG. 3. When used to control a horse, both of these halters exert pressure on the horse's poll, which is the area behind the ears, but they do not exert pressure anywhere else. Neither of these halters incorporates a chin strap, and neither one exerts any pressure at all on the horse's nose or jaw, which is a much more sensitive area than the horse's poll.

Horses can exert a great deal of counter-pressure in the poll area, which is why they often tear or rip through the halters depicted in FIGS. 1-4. FIGS. 2 and 4 show the prior art strap and rope halters, respectively, when the horse handler pulls on the lead rope. As illustrated in these figures, the only pressure that these halters exert is in the poll area of the horse. No pressure is exerted downward on the nose or upward on the jaw. Because horses are so much more sensitive in the nose area than they are in the poll area, a halter that exerted pressure on the horse's nose while simultaneously maintaining the jaw in a stationary position so as to create a clamping action between nose and jaw would be much more effective in controlling the horse than a halter that exerted pressure solely in the poll area or even one that exerted pressure downward on the nose without simultaneously exerting pressure upward on the jaw.

There are a number of patents that have been issued for various types of horse halters, including, by way of example, U.S. Pat. No. 28,121 (Whitehead, 1860); U.S. Pat. No. 100,031 (Harris, 1870); U.S. Pat. No. 200,720 (Henkell, 1878); U.S. Pat. No. 237,031 (Mauk et al., 1881); U.S. Pat. No. 251,074 (Stowell, 1881); U.S. Pat. No. 255,395 (Rorebeck, 1882); U.S. Pat. No. 286,602 (Garfield, 1883); U.S. Pat. No. 288,595 (Rorebeck, 1883); U.S. Pat. No. 321,957 (Enoch, 1885); U.S. Pat. No. 428,898 (Duncan, 1890); U.S. Pat. No. 432,414 (Knight, 1890); U.S. Pat. No. 462,743 (Sisson, 1891); U.S. Pat. No. 660,494 (Evans, 1900); U.S. Pat. No. 904,321 (Farrar, 1908); U.S. Pat. No. 923,369 (McClintock, 1909); U.S. Pat. No. 925,372 (McClintock, 1909); U.S. Pat. No. 1,325,061 (Veal, 1919); and U.S. Pat. No. 4,472,925 (Woodruff, 1984).

Of particular note are U.S. Pat. No. 100,031 (Harris, 1870), which covers a strap halter in which the nose strap passes through a first ring underneath the horse's jaw and is fixedly attached to a second ring also located underneath the horse's jaw and through which the tie-strap (or hitching strap) passes, and U.S. Pat. No. 4,472,925 (Woodruff, 1984), which covers a rope halter in which the reins pass through rings on either side of the horse's jaw and then through a ring underneath the horse's jaw. Both of these halters provide some degree of pressure on the top of the horse's nose, but neither one exerts a clamping pressure on the forward portion of the horse's nose and jaw. The halter described in the '031 patent does not exert any clamping pressure on the horse's nose and jaw because the strap underneath the horse's jaw is not fixedly attached to the nose band (in other words, it is free to move downward when pressure is exerted on the nose band) and because there is no chin strap. The halter described in the '925 patent achieves a clamping action of sorts, but the clamping action is not on the forward portion of the horse's nose and jaw; instead, it is further back toward the horse's throat. The further forward the clamping action, the more uncomfortable it is for the horse, which makes the halter of the present invention more effective than that of the '925 patent.

It is an object of the present invention to provide a horse halter that more effectively controls the horse than prior art halters by effectuating a clamping action on the forward portion of the horse's nose and jaw when the lead rope is pulled. It is a further object of the present invention to provide a horse halter that is relatively easy and inexpensive to manufacture.

BRIEF SUMMARY OF THE INVENTION

The present invention is a horse halter comprising a nose band; a chin strap; a hitching strap; a jaw strap; a throat strap; two cheek straps; a poll strap; two first rings; a second ring; two third rings; and a fourth ring; wherein the nose band lies across the top of a horse's nose and joins together at a point under the horse's chin to form the hitching strap; wherein the fourth ring is at the end of the hitching strap; wherein a lead rope is attached to the fourth ring; wherein the fourth ring prevents the second ring from sliding downward on the hitching strap past the fourth ring; wherein the second ring wraps around the hitching strap so that the hitching strap slides within the second ring; wherein the second ring is attached to a first end of the jaw strap; wherein a second end of the jaw strap is attached to the throat strap; wherein a first end of the throat strap is attached to a third ring on one side of the horse's head, and a second end of the throat strap is attached to a third ring on the other side of the horse's head; wherein the throat strap extends downward from one third ring, around the horse's throat, and upward to the other third ring; wherein each third ring is attached to the throat strap, the poll strap, and one of the cheek straps; wherein each cheek strap extends from the third ring to the first ring; wherein the poll strap extends upward from one third ring, around the horse's poll, and downward to the other third ring; wherein the chin strap extends around the horse's chin and is attached on either end to the first ring; wherein each first ring is attached to the chin strap, one end of one of the cheek straps, and the nose band; and wherein the second ring slides upward on the hitching strap when the lead rope is pulled downward but no further than the point at which the nose band comes together to form the hitching strap underneath the horse's chin.

In a preferred embodiment, the nose band comprises two slots that allow the first rings to move vertically inside the slots. Preferably, the second end of the jaw strap is slidably attached to the throat strap.

In a preferred embodiment, the first ring preferably extends through a slot in the nose band, and the nose band is preferably stitched at a point that is roughly parallel to the third ring, thereby allowing the first rings to slide upward in the slots of the nose band when the lead rope is pulled downward but preventing them from sliding downward. Preferably, the poll strap comprises a buckle so that the length of the poll strap can be adjusted to fit the horse.

In a preferred embodiment, the chin strap is comprised of a woven strap material that provides some give when the horse opens its mouth but that is not so elastic as to provide no resistance at all. Preferably, when the lead rope is pulled downward, downward pressure is exerted on the nose band, and the chin strap maintains the horse's jaw in a stationary position, thereby providing a clamping action on the horse's nose and mouth.

In a preferred embodiment, when the lead rope is pulled downward, the first rings compress inward, exerting a lateral pressure on the horse's nose.

In an alternate embodiment, the present invention is a horse halter comprising a nose band; a chin strap; a hitching strap; a jaw strap; a throat strap; two cheek straps; and a poll strap; wherein the entire halter is comprised of three pieces of rope and contains no hardware; wherein the first two pieces of rope form the nose band and hitching strap; wherein the third piece of rope forms the poll strap, throat strap, jaw strap and cheek straps; wherein a portion of the nose band lies across the top of the horse's nose, and portions of the nose band come together under the horse's chin at a fourth knot to form the hitching strap; wherein the fourth knot prevents a second sliding loop from sliding downward beyond the fourth knot; wherein the second sliding loop wraps around the portions of the nose band that are underneath the horse's chin; wherein the second sliding loop is located at a first end of the jaw strap; wherein a second end of the jaw strap culminates in a fifth knot directly underneath the horse's throat; wherein the second sliding loop is formed by the third knot; wherein the third knot is located directly underneath a first knot in each cheek strap; wherein at the fifth knot, the piece of rope that comprises the jaw strap divides into two strands, with one strand forming the throat strap on one side of the horse's throat and the other strand forming the throat strap on the other side of the horse's throat; wherein the throat straps join the cheek straps at a sixth knot; wherein the throat strap, cheek strap and poll strap come together at the sixth knot on either side of the horse's head; wherein the poll strap extends upward from the sixth knot on one side of the horse's head, around the poll area of the horse, and downward to the sixth knot on the other side of the horse's head; wherein at the sixth knot the piece of rope that comprises the poll strap divides into two strands, with one strand forming the throat strap and the other strand forming the cheek strap; wherein one end of the cheek strap culminates in the first knot, and the other end of the cheek strap culminates in the sixth knot; wherein a first sliding loop extends around the nose band above a second knot and adjacent to the first knot; wherein the second knot prevents the first sliding loop from sliding downward on the nose band; wherein the first sliding loop maintains the cheek straps in a position that is roughly parallel to the horse's jaw by sliding upward on the nose band above the second knot when a lead rope attached to the hitching strap is pulled downward; wherein the piece of rope that forms the poll strap, throat strap, jaw strap and cheek straps comprises two ends, and wherein the poll strap comprise a seventh knot that ties together the two ends of the piece of rope that forms the poll strap, throat strap, jaw strap and cheek straps; and wherein the seventh knot is untied to fit the halter on a horse.

In a preferred embodiment, the hitching strap is a loop to which a lead rope is attached. Preferably, the second knot is located at a position roughly parallel to the sixth knot.

In a preferred embodiment, the two strands of rope that comprise the nose band are glued together at a point directly on top of the horse's nose. Preferably, the nose band comprises a decorative leather band that conceals the point at which the two strands of rope that comprise the nose band are glued together.

In a preferred embodiment, a lead rope is attached to the hitching strap, and when the lead rope is pulled downward, pressure is exerted on the poll strap and nose band. Preferably, when downward pressure is exerted on the nose band, the chin strap maintains the horse's jaw in a stationary position, thereby providing a clamping action on the horse's nose and mouth.

In a preferred embodiment, a lead rope is attached to the hitching strap, and when the lead rope is pulled downward, the second sliding loop slides upward on the portion of the nose band that is underneath the horse's chin to maintain the cheek straps in a position that is roughly parallel to the horse's jaw when the horse's mouth is closed. Preferably, when the lead rope is pulled downward, the second knots compress inward, exerting a lateral pressure on the horse's nose.

REFERENCE NUMBERS

Figure 2:
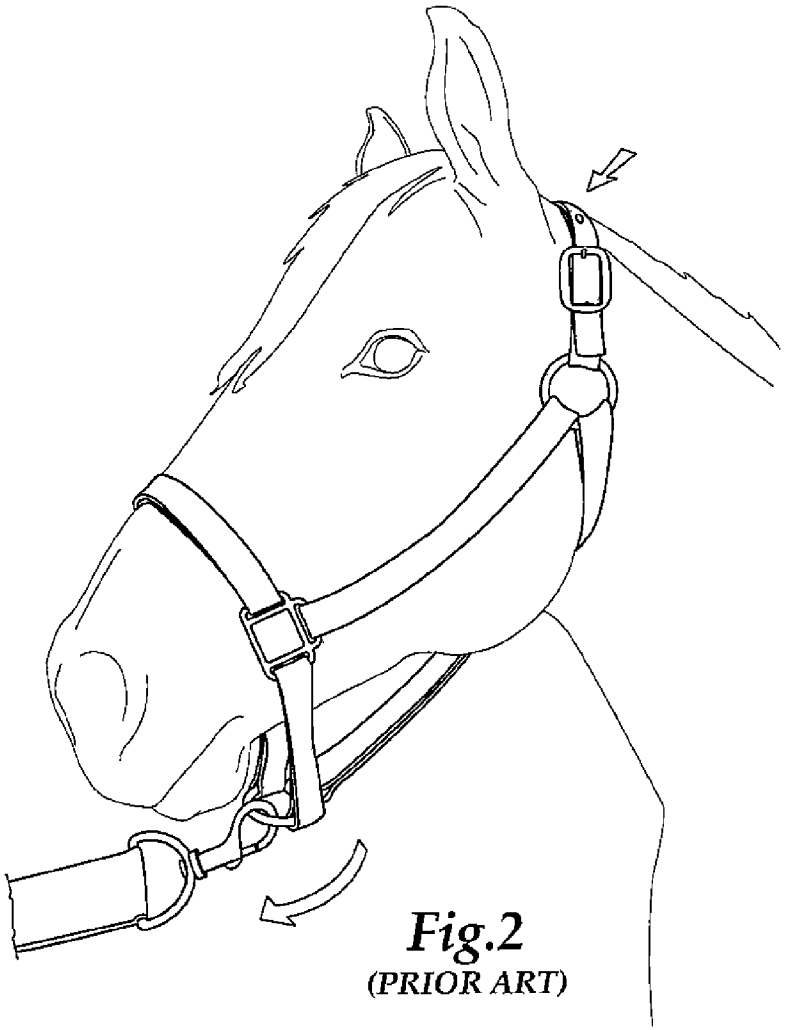
Fig.2 (PRIOR ART)
FIG. 2 is a perspective view of a prior art strap halter shown on a horse with the lead rope being pulled downward.
Figure 1:
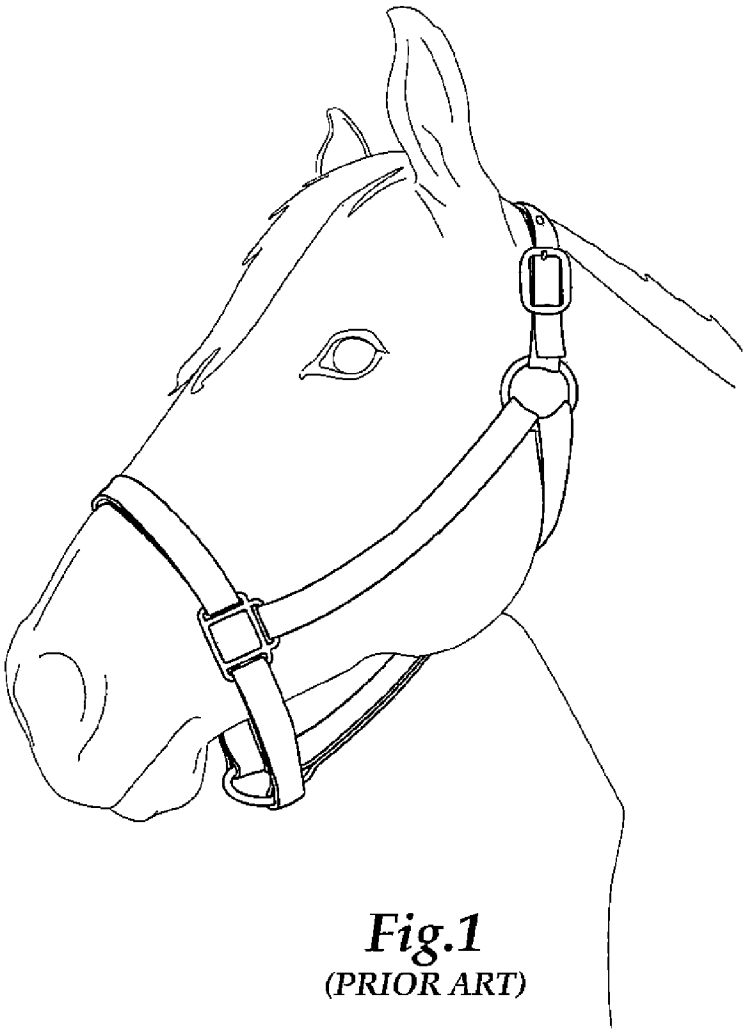
Fig.1 (PRIOR ART)
FIG. 1 is a perspective view of a prior art strap halter shown on a horse.
Figure 4:
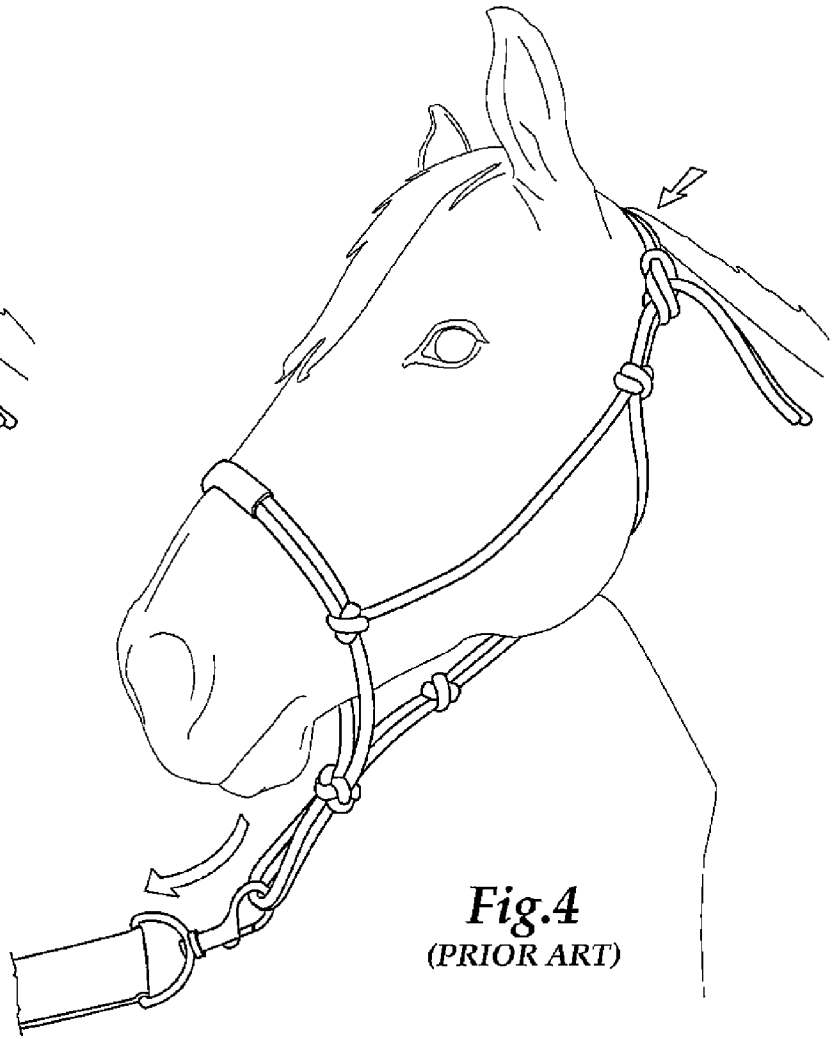
Fig.4 (PRIOR ART)
FIG. 4 is a perspective view of a prior art rope halter shown on a horse with lead rope being pulled downward.
Figure 3:
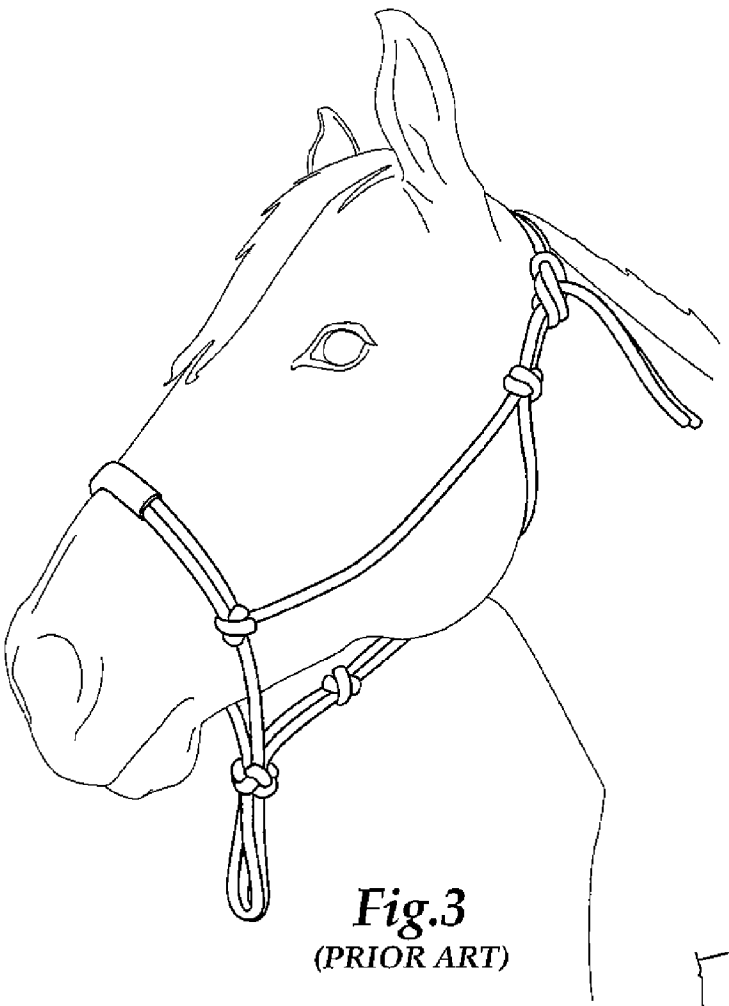
Fig.3 (PRIOR ART)
FIG. 3 is a perspective view of a prior art rope halter shown on a horse.

1 Nose band
2 Chin strap
3 Hitching strap
4 Jaw strap
5 Throat strap
6 Cheek strap
7 Poll strap
8 First ring
9 Second ring
10 Third ring
11 Fourth ring
12 Slot in nose band
13 Buckle
14 Lead rope
15 First knot

16 First sliding loop
17 Second knot
18 Third knot
19 Second sliding loop
20 Fourth knot
21 Fifth knot
22 Sixth knot
23 Seventh knot
24 Leather band

DETAILED DESCRIPTION OF INVENTION

The present invention is best described with reference to FIGS. 5-16. FIGS. 5-10 depict the strap halter embodiment of the present invention, and FIGS. 11-16 depict the rope halter embodiment.

Figure 5:
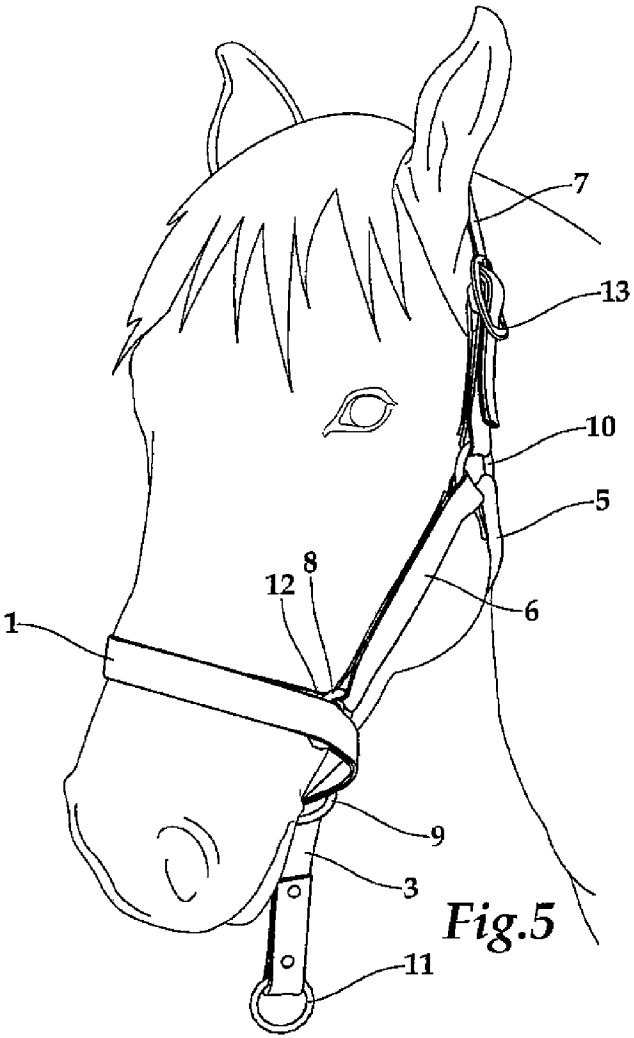
FIG. 5 is a first perspective view of the strap halter embodiment of the present invention shown on a horse.

FIG. 5 is a first perspective view of the strap halter embodiment of the present invention shown on a horse. The strap halter embodiment comprises a nose band 1, a chin strap 2 (not shown), a hitching strap 3, a jaw strap 4 (not shown), a throat strap 5, two cheek straps 6, a poll strap 7, two first rings 8, a second ring 9, two third rings 10, and a fourth ring 11. The nose band lies across the top of the horse's nose and joins together under the horse's chin to form the hitching strap 3. At the end of the hitching strap is the fourth ring 11, to which the lead rope 14 (not shown) is attached. The fourth ring 11 prevents the second ring 9 from sliding downward on the hitching strap 3 past the fourth ring 11. The nose band 1 preferably comprises two slots 12 (more clearly visible in FIGS. 9 and 10), which allow the first rings 8 to move vertically inside the slots.

Figure 9:
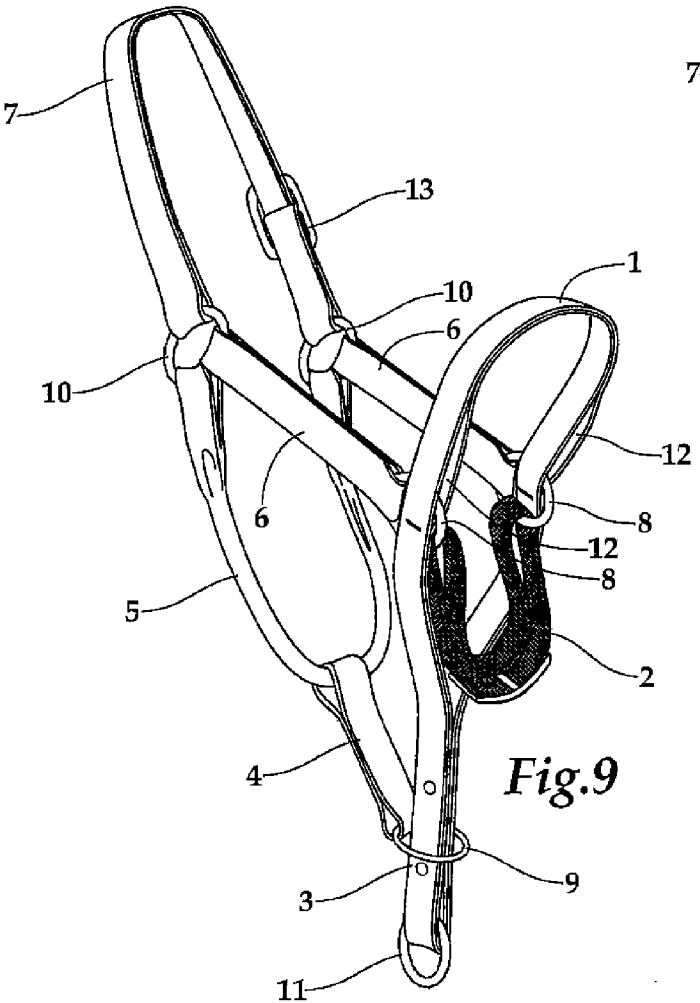
FIG. 9 is a perspective view of the strap halter embodiment of the present invention shown without the horse.

The second ring 9 wraps around the hitching strap 3 (so that the hitching strap 3 slides within the second ring 9) and is attached to one end of the jaw strap 4. The other end of the jaw strap 4 is attached (preferably slidably attached, as shown in FIG. 9, by means of a loop in the jaw strap 4) to the throat strap 5. One end of the throat strap 5 is attached to a third ring 10 on one side of the horse's head, and the other end of the throat strap 5 is attached to a third ring 10 on the other side of the horse's head. The throat strap 5 extends downward from one third ring 10, around the horse's throat, and upward to the other third ring 10. Each third ring 10 is attached to the throat strap 5, the poll strap 7, and one of the cheek straps 6. Each cheek strap 6 extends from the third ring 10 to the first ring 8. The poll strap 7 extends upward from one third ring 10, around the horse's poll, and downward to the other third ring 10.

The chin strap 2 extends around the horse's chin (see FIG. 6) and is attached on either end to the first ring 8. Each first ring 8 is attached to the chin strap 2, one end of one of the cheek straps 6, and the nose band 1. The first ring 8 preferably extends through a slot 12 in the nose band 1, and the nose band 1 is preferably stitched at a point that is roughly parallel to the third ring 10, thereby allowing the first rings 8 to slide upward in the slots 12 of the nose band 1 when the lead rope is pulled downward (see FIG. 10) but preventing them from sliding downward. In this manner, the cheek straps 6 maintain the position that is shown in FIGS. 6 and 7 at all times.

The second ring 9 slides upward on the hitching strap 3 (but no further upward than the point at which the nose band 1 comes together to form the hitching strap 3 underneath the horse's chin) when the lead rope is pulled downward. The poll strap 7 preferably comprises a buckle 13 so that the length of the poll strap 7 can be adjusted to fit the horse.

Figure 6:
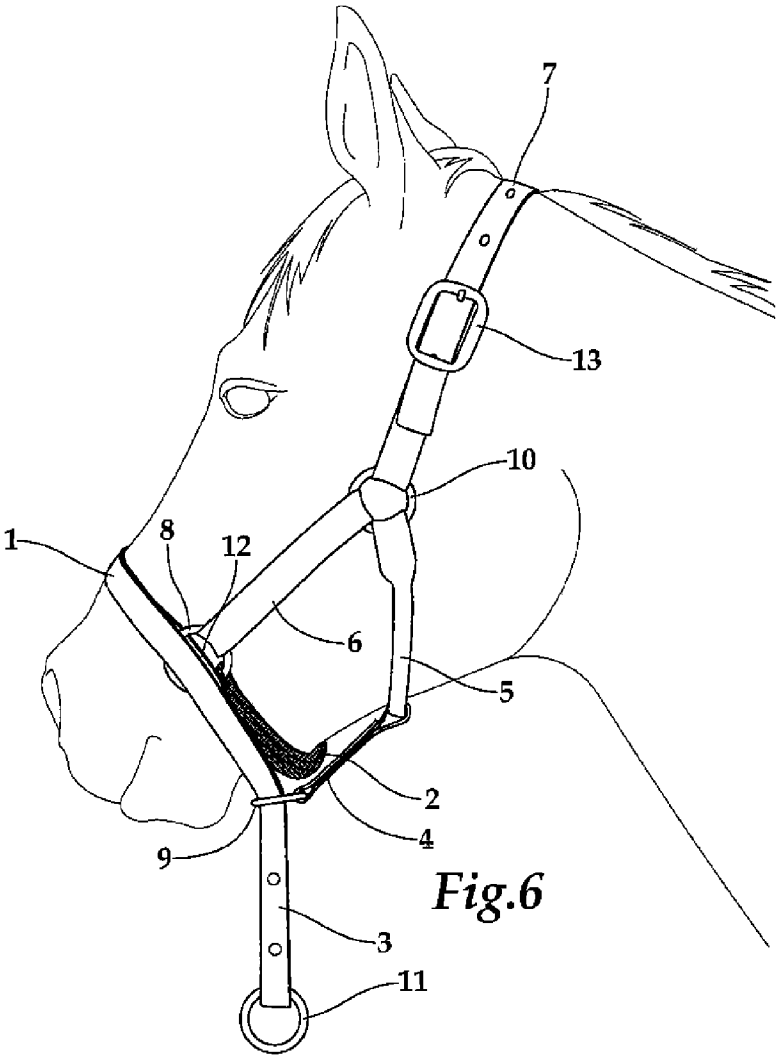
FIG. 6 is a first side view of the strap halter embodiment of the present invention shown on a horse.
Figure 7:
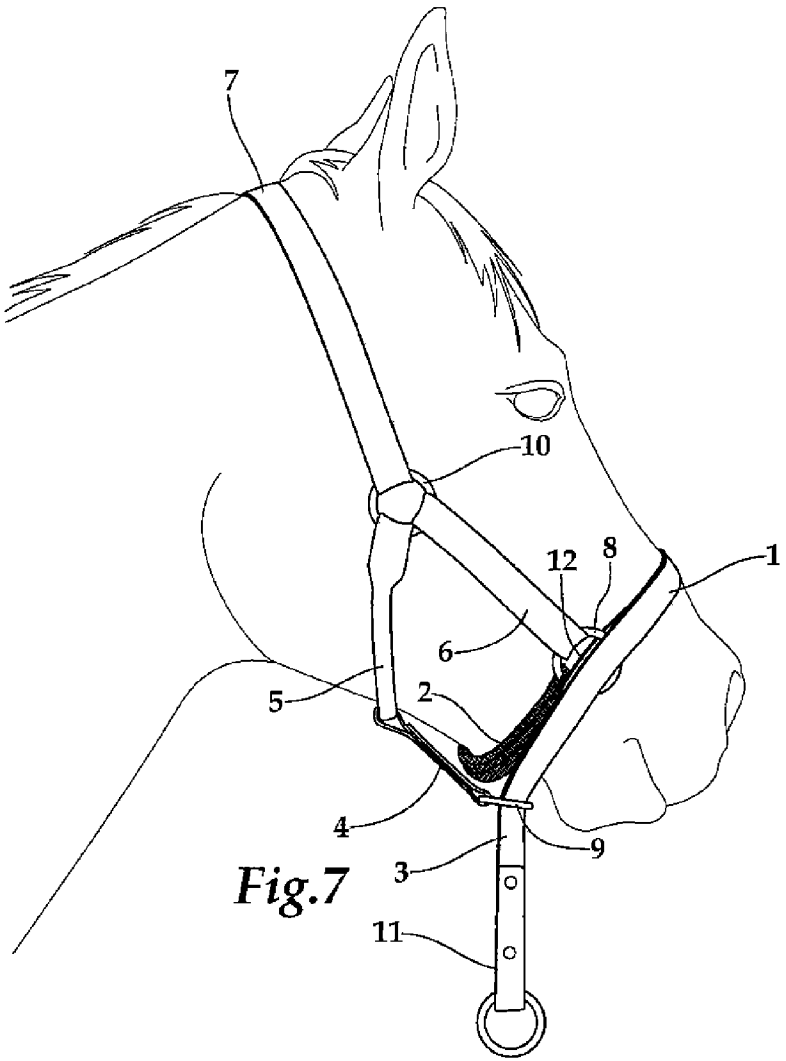
FIG. 7 is a second side view of the strap halter embodiment of the present invention shown on a horse.

FIGS. 6 and 7 are first and second side views, respectively, of the strap halter embodiment of the present invention shown on a horse. The halter preferably comes in different sizes so that the only adjustment that needs to be made when the halter is fitted to the horse is to adjust the length of the poll strap 7 using the buckle 13. As illustrated in these figures, the cheek straps 6 preferably maintain a position on the horse's head that is roughly parallel to the horse's jaw when the horse's mouth is closed.

Figure 8:
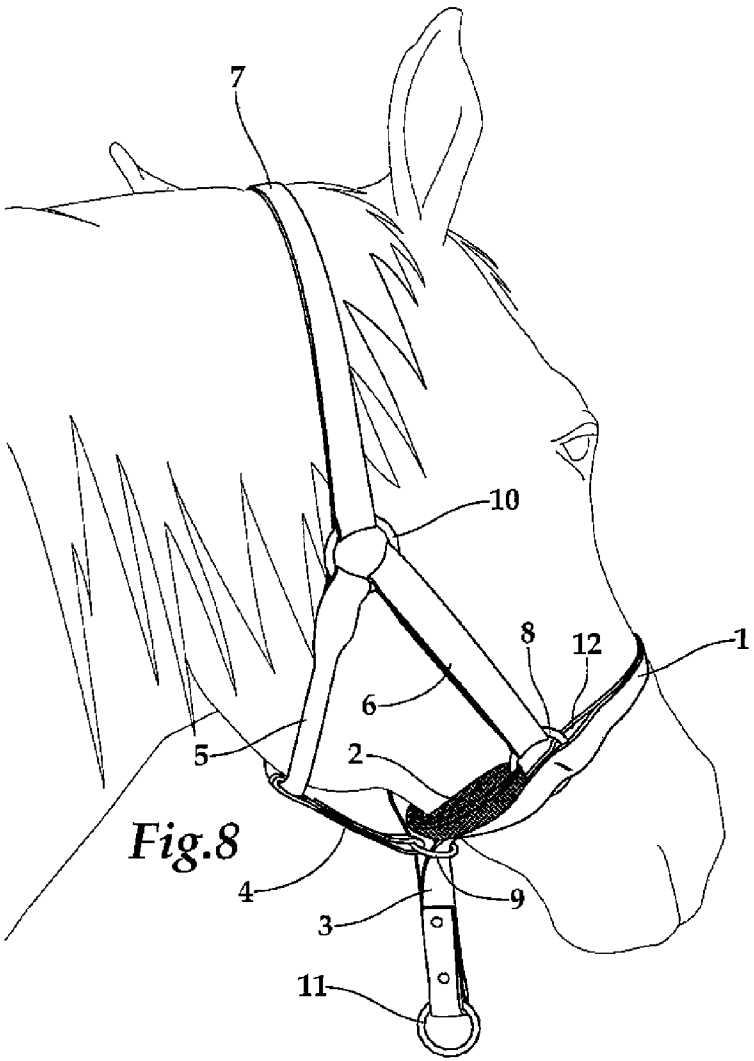
FIG. 8 is a second perspective view of the strap halter embodiment of the present invention shown on a horse.

FIG. 8 is a second perspective view of the strap halter embodiment of the present invention shown on a horse. This view shows more clearly the area of the halter that is underneath the horse's chin and underneath the horse's throat. This figure clearly shows that the first ring 8 cannot slip downward in the slot 12 in the nose band 1 beyond the stitching that is located roughly parallel to the third ring 10. The chin strap 2 closely cradles the horse's chin and is preferably comprised of a woven strap material that provides some give when the horse opens its mouth but that is not so elastic as to provide no resistance at all. All other parts of the strap halter, with the exception of the rings, are preferably made of a nylon strap.

Figure 10:
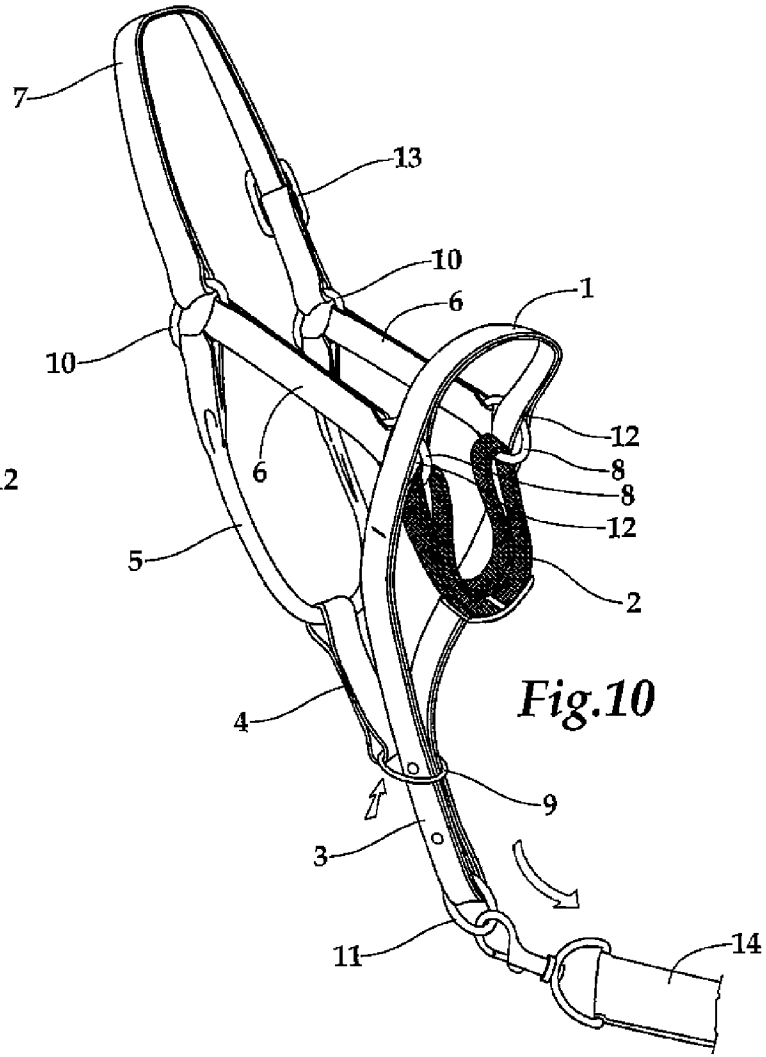
FIG. 10 is a perspective view of the strap halter embodiment of the present invention shown without the horse with the lead rope being pulled downward.

FIG. 9 is a perspective view of the strap halter embodiment of the present invention shown without the lead rope (with the halter in a relaxed state). FIG. 10 is a perspective view of the strap halter embodiment shown with the lead rope being pulled downward (with the halter in a tensioned state). Both of these figures are shown without the horse for clarity.

These two figures together illustrate the mechanism of the strap halter embodiment of the present invention. When the lead rope is pulled downward, pressure is exerted not only on the poll strap 7 but also on the nose band 1. As stated above, the second ring 9 may slide upward on the hitching strap 3 when the lead rope is pulled downward. When downward pressure is exerted on the nose band 1, the chin strap 2 maintains the horse's jaw in a stationary position, thereby providing a clamping action on the horse's nose. This clamping action is not provided by prior art halter designs and is a more effective way to control the horse than simply exerting pressure on the poll area. When the lead rope is pulled downward, the first rings 8 also compress inward (toward each other), exerting an additional lateral pressure on the horse's nose.

Figure 12:
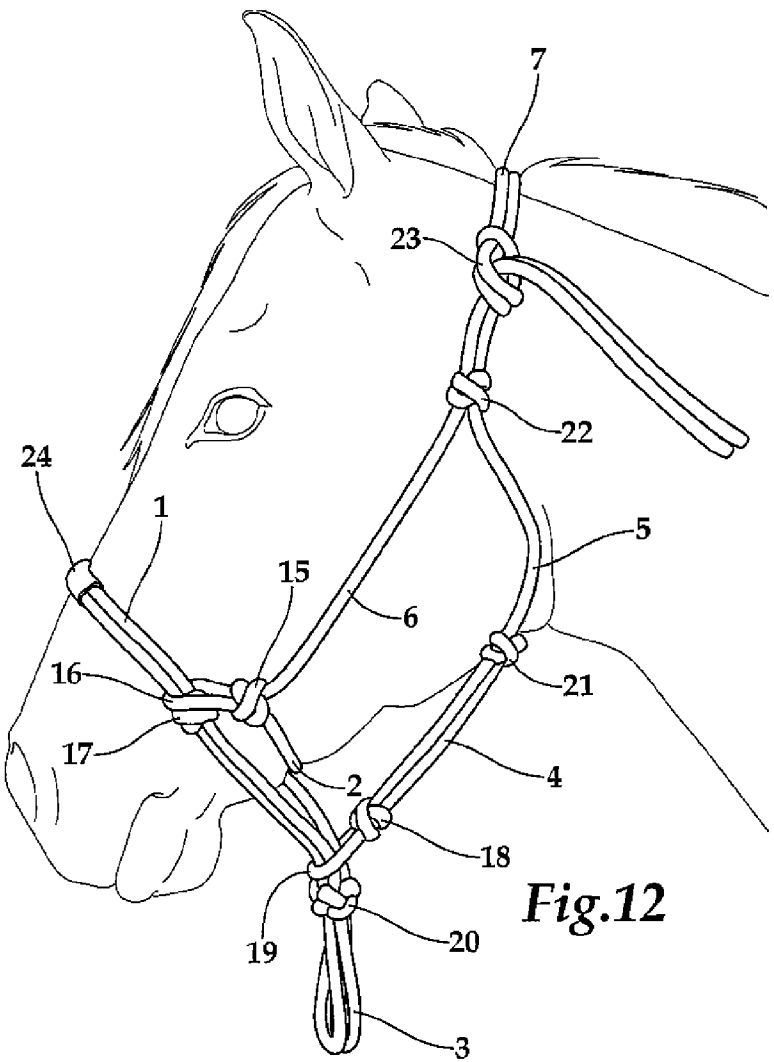
FIG. 12 is a first side view of the rope halter embodiment of the present invention shown on a horse.
Figure 11:
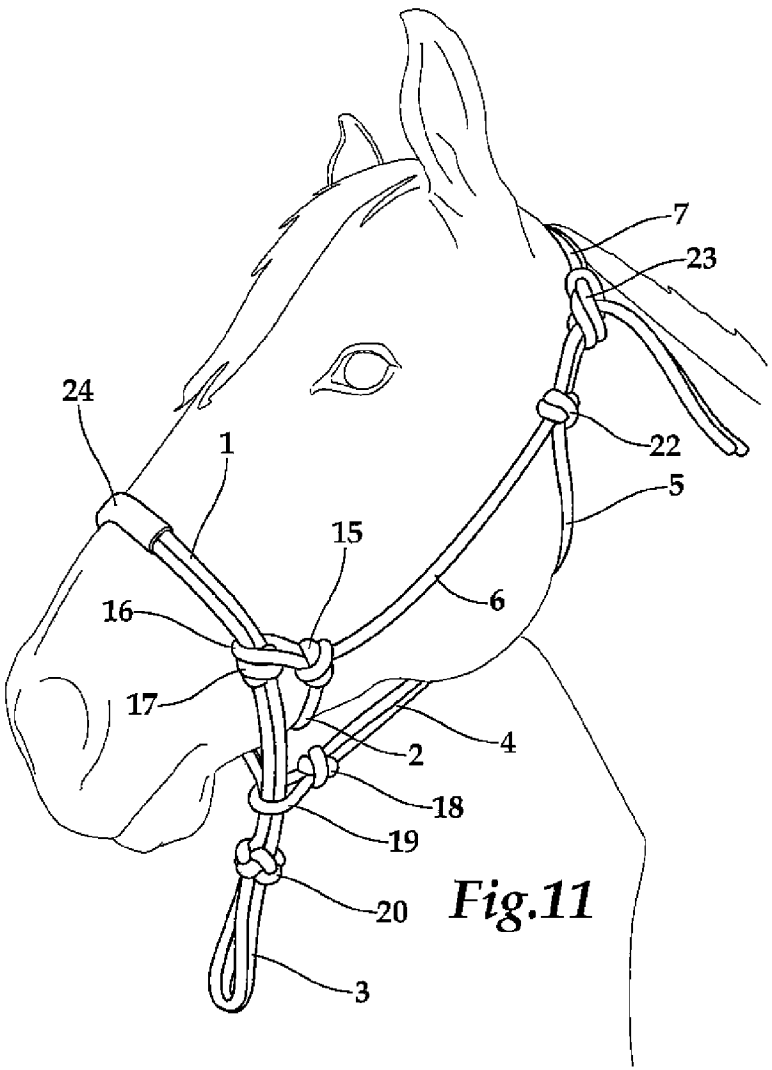
FIG. 11 is a first perspective view of the rope halter embodiment of the present invention shown on a horse.
Figure 14:
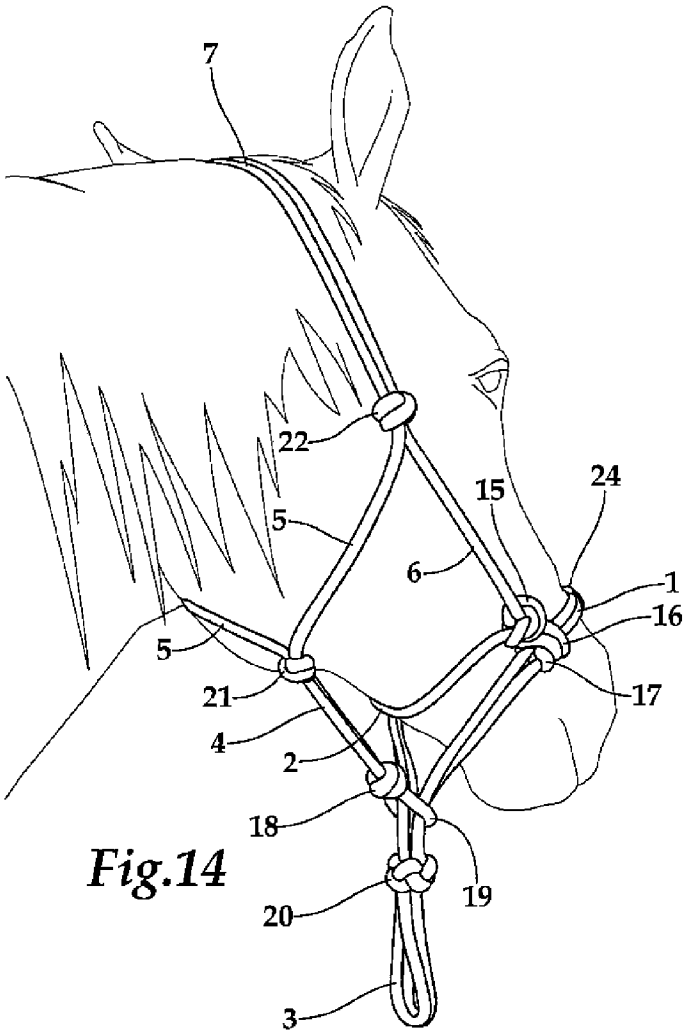
FIG. 14 is a second perspective view of the rope halter embodiment of the present invention shown on a horse.
Figure 13:
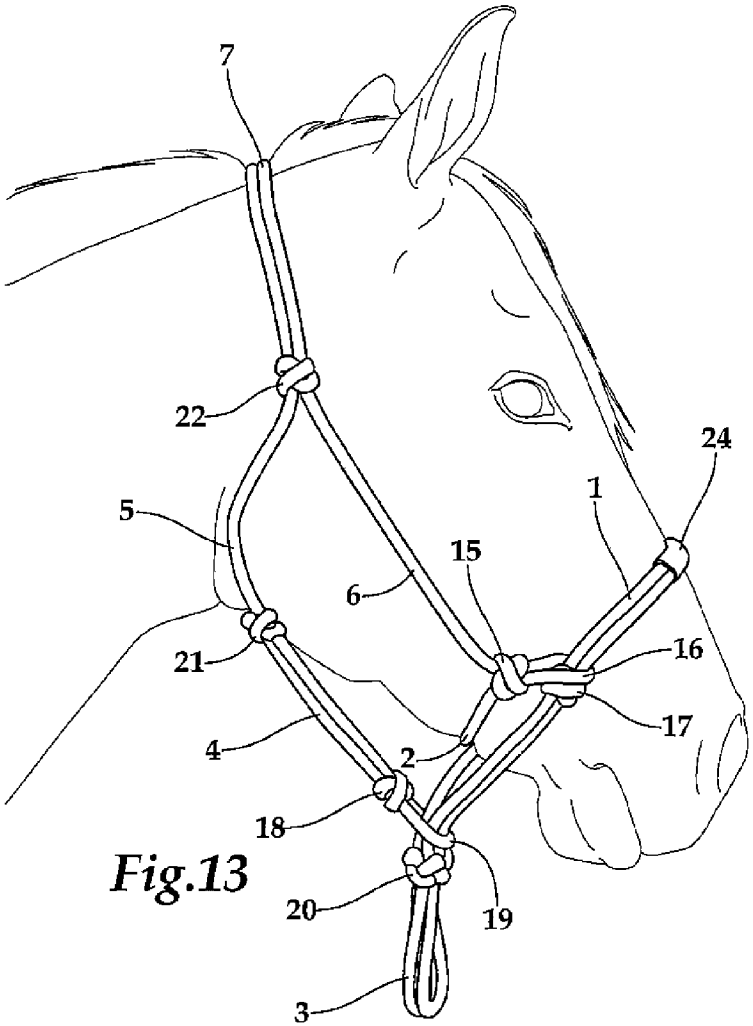
FIG. 13 is a second side view of the rope halter embodiment of the present invention shown on a horse.
Figure 16:
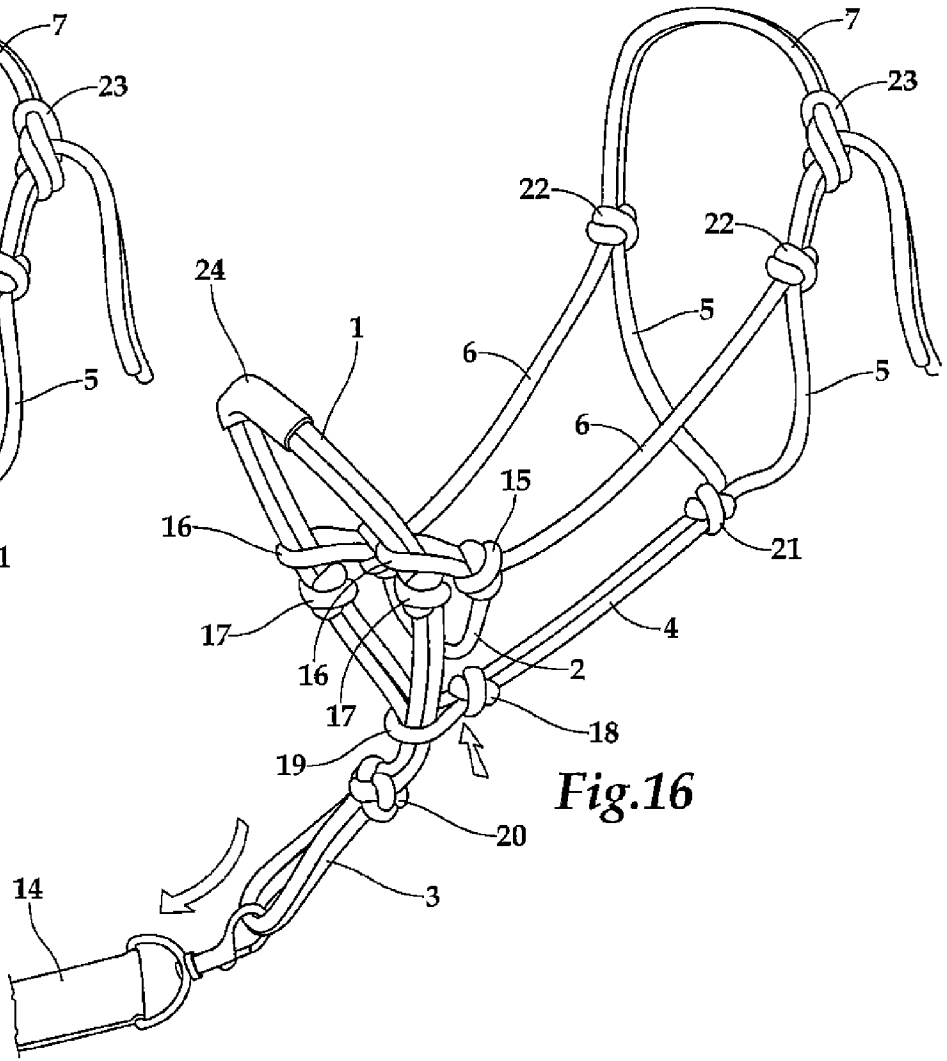
FIG. 16 is a perspective view of the rope halter embodiment of the present invention shown without the horse with the lead rope being pulled downward.

FIG. 11 is a first perspective view of the rope halter embodiment of the present invention shown on a horse. FIGS. 12-14 are, respectively, a first side view, a second side view, and a second perspective view of the rope halter embodiment shown on a horse.

The rope halter embodiment, like the strap halter embodiment, comprises a nose band 1, a chin strap 2, a hitching strap 3, a jaw strap 4, a throat strap 5, two cheek straps 6, and a poll strap 7. The entire rope halter is preferably comprised of three pieces of rope and, therefore, contains no hardware (no rings or buckle). The first two pieces of rope form the nose band 1 and hitching strap 3, and the third piece of rope forms the poll strap 7, throat strap 5, jaw strap 4 and cheek straps 6. In lieu of hardware, the rope halter utilizes a series of strategically located knots to accomplish the same effect as the strap halter.

As shown in FIG. 11, the nose band 1 lies across the top of the horse's nose and comes together under the horse's chin at the fourth knot 20 to form the hitching strap 3. The hitching strap 3 is preferably a loop to which the lead rope can be attached. The fourth knot 20 serves a function similar to the fourth ring 11 of the strap halter embodiment in that it prevents the second sliding loop 19 from sliding downward beyond the fourth knot 20. The second sliding loop 19 wraps around the portion of the nose band 1 that is underneath the horse's chin and serves a function similar to the second ring 9 of the strap halter embodiment. The second sliding loop 19 is located at one end of the jaw strap 4. The other end of the jaw strap 4 culminates in a fifth knot 21 directly underneath the horse's throat. The second sliding loop 19 is formed by the third knot 18, located directly underneath the first knot 15 in the cheek strap 6.

At the fifth knot 21, the piece of rope that comprises the jaw strap 4 divides into two strands, with one strand forming the throat strap 5 on one side of the horse's throat and the other strand forming the throat strap 5 on the other side of the horse's throat. The throat straps 5 join the cheek straps at the sixth knot 22. The sixth knot 22 serves a function similar to the third ring 10 of the strap halter embodiment in that it is the point at which the throat strap, cheek strap and poll strap come together. In the rope halter embodiment, the poll strap 7 extends upward from the sixth knot 22 on one side of the horse's head, around the poll area of the horse, and downward to the sixth knot 22 on the other side of the horse's head. At the sixth knot, the piece of rope that comprises the poll strap 7 divides into two strands, with one strand forming the throat strap 5 and the other strand forming the cheek strap 6. The opposite end of the cheek strap 6 culminates in the first knot 15, which serves the same purpose as the first ring 8 of the strap halter embodiment. Just beyond the first knot 15 is a first sliding loop 16, which extends around the nose band above the second knot 17.

The second knot 17 serves a function similar to the stitching in the nose band of the strap halter embodiment in that it prevents the first sliding loop 16 from sliding downward on the nose band 1. The second knot is preferably located at a position roughly parallel to the sixth knot. The first sliding loop 16 serves a function similar to the first ring 8 of the strap halter embodiment in that it maintains the cheek straps 6 in a position that is roughly parallel to the horse's jaw when the lead rope is pulled downward by sliding upward on the nose band above the second knot 17.

The poll strap 7 comprises a seventh knot 23, which ties together the two ends of the piece of rope that forms the poll strap 7, throat strap 5, jaw strap 4 and cheek straps 6, and serves a function similar to the buckle 13 of the strap halter embodiment in that this knot is untied to fit the halter on the horse and can be adjusted to fit the poll area of the horse.

The two strands of rope that comprise the nose band 1 are preferably glued together (end-to-end) at a point directly on top of the horse's nose. The nose band optionally comprises a decorative leather band 24 that conceals this point.

Figure 15:
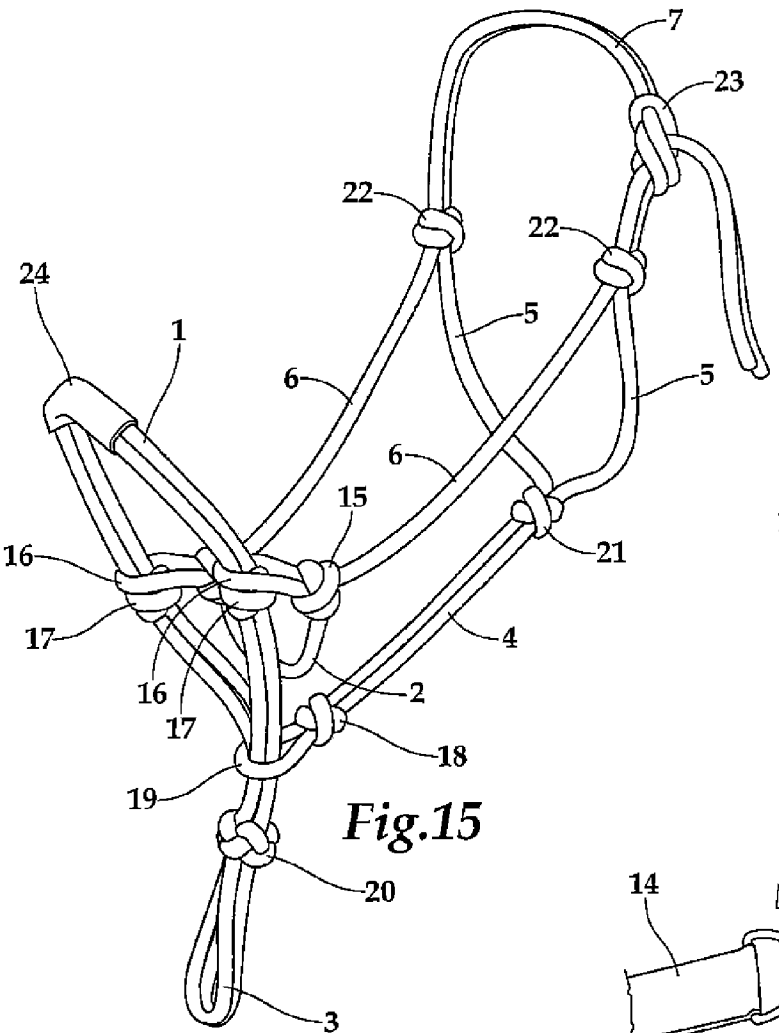
FIG. 15 is a perspective view of the rope halter embodiment of the present invention shown without the horse.

FIG. 15 is a perspective view of the rope halter embodiment of the present invention shown without the lead rope (with the halter in a relaxed state). FIG. 10 is a perspective view of the strap halter embodiment shown with the lead rope being pulled downward (with the halter in a tensioned state). Both of these figures are shown without the horse for clarity.

These two figures together illustrate the mechanism of the rope halter embodiment of the present invention, which is similar in function to the mechanism of the strap halter embodiment. When the lead rope is pulled downward, pressure is exerted not only on the poll strap 7 but also on the nose band 1. The second sliding loop 19 may slide upward on the portion of the nose band 1 that is underneath the horse's chin when the lead rope is pulled downward in order to maintain the cheek straps in the position shown in FIGS. 12 and 13, that is, roughly parallel to the horse's jaw when the horse's mouth is closed. When downward pressure is exerted on the nose band 1, the chin strap 2 maintains the horse's jaw in a stationary position, thereby providing a clamping action on the horse's nose. This clamping action is not provided by prior art halter designs and is a more effective way to control the horse than simply exerting pressure on the poll area. When the lead rope is pulled downward, the second knots 17 also compress inward (toward each other), exerting an additional lateral pressure on the horse's nose.

Although the preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A horse halter comprising:

(a) a nose band;

(b) a chin strap;

(c) a hitching strap;

(d) a jaw strap;

(e) a throat strap;

(f) two cheek straps;

(g) a poll strap;

(h) first, second, third, fourth, fifth, sixth and seventh knots; and (i) first and second sliding loops;

wherein the entire halter is comprised of three pieces of rope and contains no hardware;

wherein the first two pieces of rope form the nose band and hitching strap;

wherein the third piece of rope forms the poll strap, throat strap, jaw strap and cheek straps;

wherein a portion of the nose band lies across the top of the horse's nose, and portions of the nose band come together under the horse's chin at the fourth knot to form the hitching strap;

wherein the fourth knot prevents the second sliding loop from sliding downward beyond the fourth knot;

wherein the second sliding loop wraps around the portions of the nose band that are underneath the horse's chin;

wherein the second sliding loop is located at a first end of the jaw strap;

wherein a second end of the jaw strap culminates in the fifth knot directly underneath the horse's throat;

wherein the second sliding loop is formed by the third knot;

wherein the third knot is located directly underneath the first knot in each cheek strap;

wherein at the fifth knot, the piece of rope that comprises the jaw strap divides into two strands, with one strand forming the throat strap on one side of the horse's throat and the other strand forming the throat strap on the other side of the horse's throat;

wherein the throat straps join the cheek straps at the sixth knot;

wherein the throat strap, cheek strap and poll strap come together at the sixth knot on either side of the horse's head;

wherein the poll strap extends upward from the sixth knot on one side of the horse's head, around the poll area of the horse, and downward to the sixth knot on the other side of the horse's head;

wherein at the sixth knot, the piece of rope that comprises the poll strap divides into two strands, with one strand forming the cheek strap;

wherein one end of the cheek strap culminates in the first knot, and the other end of the cheek strap culminates in the sixth knot;

wherein the first sliding loop extends around the nose band above the second knot and adjacent to the first knot;

wherein the second knot prevents the first sliding loop from sliding downward on the nose band;

wherein the first sliding loop maintains the cheek straps in a position that is roughly parallel to the horse's jaw by sliding upward on the nose band above the second knot when a lead rope attached to the hitching strap is pulled downward;

wherein the piece of rope that forms the poll strap, throat strap, jaw strap and cheek straps comprises two ends, and wherein the poll strap comprise the seventh knot that ties together the two ends of the piece of rope that forms the poll strap, throat strap, jaw strap and cheek straps; and wherein the seventh knot can be untied to fit the halter on a horse.

2. The horse halter of claim 1, wherein the hitching strap is a loop to which a lead rope is attached.

3. The horse halter of claim 1, wherein the second knot is located at a position roughly parallel to the sixth knot.

4. The horse halter of claim 1, wherein the two strands of rope that comprise the nose band are glued together at a point directly on top of the horse's nose.

5. The horse halter of claim 4, wherein the nose band comprises a decorative leather band that conceals the point at which the two strands of rope that comprise the nose band are glued together.

6. The horse halter of claim 1, wherein a lead rope is attached to the hitching strap, and wherein when the lead rope is pulled downward, pressure is exerted on the poll strap and nose band.

7. The horse halter of claim 6, wherein when downward pressure is exerted on the nose band, the chin strap maintains the horse's jaw in a stationary position, thereby providing a clamping action on the horse's nose and mouth.

8. The horse halter of claim 1, wherein a lead rope is attached to the hitching strap, and wherein when the lead rope is pulled downward, the second sliding loop slides upward on the portion of the nose band that is underneath the horse's chin to maintain the cheek straps in a position that is roughly parallel to the horse's jaw when the horse's mouth is closed.

9. The horse halter of claim 1, wherein a lead rope is attached to the hitching strap, and wherein when the lead rope is pulled downward, the second knot compress inward, exerting a lateral pressure on the horse's nose.

* * * * *